US008358184B2

(12) United States Patent
Nakamura

(10) Patent No.: US 8,358,184 B2
(45) Date of Patent: Jan. 22, 2013

(54) STRIPLINE FILTER

(75) Inventor: Soichi Nakamura, Nagaokakyo (JP)

(73) Assignee: Murata Manufacturing Co., Ltd., Nagaokakyo-Shi, Kyoto-fu (JP)

( * ) Notice: Subject to any disclaimer, the term of this patent is extended or adjusted under 35 U.S.C. 154(b) by 0 days.

(21) Appl. No.: 13/182,516

(22) Filed: Jul. 14, 2011

(65) Prior Publication Data

US 2011/0267156 A1 Nov. 3, 2011

Related U.S. Application Data

(63) Continuation of application No. PCT/JP2009/067604, filed on Oct. 9, 2009.

(30) Foreign Application Priority Data

Jan. 15, 2009 (JP) ..... 2009-006547

(51) Int. Cl.
*H01P 1/203* (2006.01)
*H01P 7/08* (2006.01)

(52) U.S. Cl. ..... 333/204; 333/219

(58) Field of Classification Search ..... 333/204, 333/219, 205, 235
See application file for complete search history.

(56) References Cited

U.S. PATENT DOCUMENTS 4,757,285 A 7/1988 Krause
5,612,656 A * 3/1997 Sakamoto et al. ..... 333/204

FOREIGN PATENT DOCUMENTS

JP 63-038305 A 2/1988
JP 5-299906 A 11/1993
JP 7-046003 A 2/1995
JP 7-312503 A 11/1995
JP 11004138 A * 1/1999
JP 2005-109951 A 4/2005
JP 2007-023461 A 2/2007

OTHER PUBLICATIONS

PCT/JP2009/067604 Written Opinion dated Dec. 24, 2009.
PCT/JP2009/067604 International Search Report dated Dec. 24, 2009.

* cited by examiner

*Primary Examiner* — Benny Lee
*Assistant Examiner* — Gerald Stevens
(74) *Attorney, Agent, or Firm* — Dickstein Shapiro LLP

(57) ABSTRACT

A stripline filter that suppresses a fundamental wave frequency without increasing the size of a board and in which a harmonic frequency is easily set to a desired frequency. The stripline filter includes a glass layer having a relative dielectric constant lower than that of a dielectric board. A first top surface line is provided on a top surface of the dielectric board and has a resonant open end. A second top surface line and a side surface electrode are provided on the glass layer so as to extend from positions connected to the first top surface line.

13 Claims, 9 Drawing Sheets

FIG. 5(A)
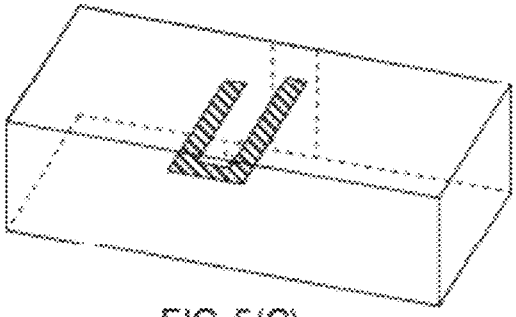
FIG. 5(B)
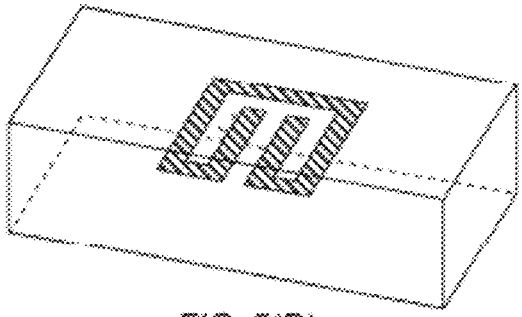
FIG. 5(C)
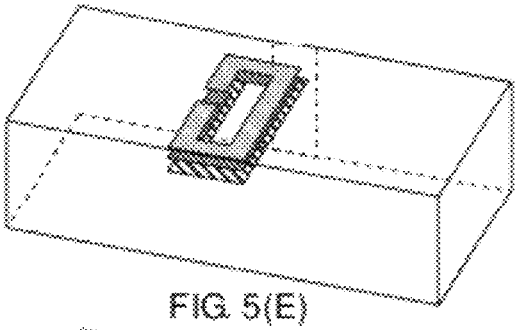
FIG. 5(D)
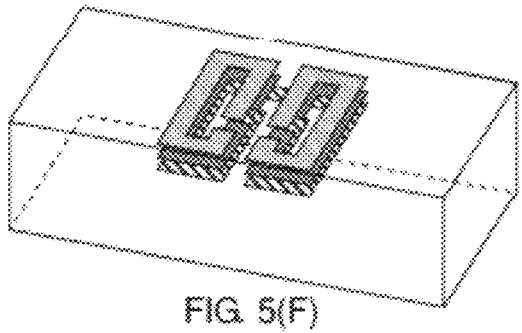
FIG. 5(E)
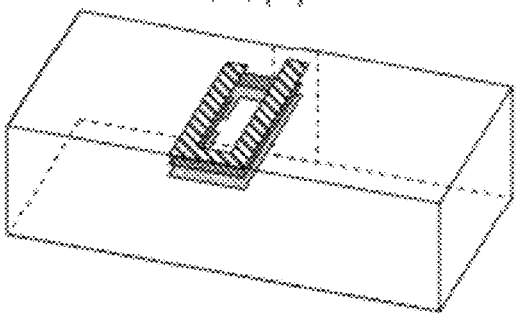
FIG. 5(F)
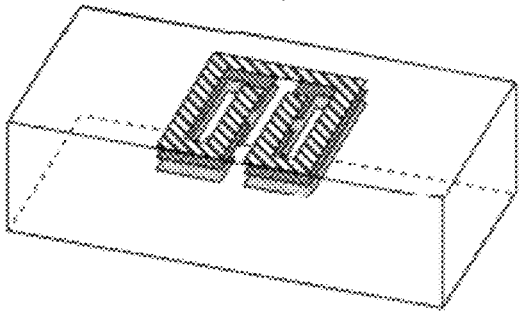
FIG. 5(G)
| | λ/4 RESONANCE | λ/2 RESONANCE |
|---|---|---|
| (a) EXISTING STRUCTURE | 8502 | 9222 |
| (b) COMPARATIVE STRUCTURE ARRANGEMENT MODEL OF SHORT-CIRCUITED END SIDE LINE ON DIELECTRIC BOARD | 8287 | 8709 |
| (c) EMBODIMENT STRUCTURE ARRANGEMENT MODEL OF OPEN END SIDE LINE ON DIELECTRIC BOARD | 3993 | 3835 |

FIG. 7(A)
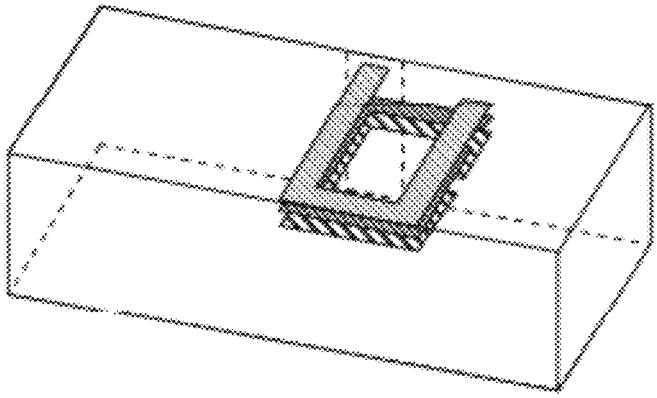
FIG. 7(B)
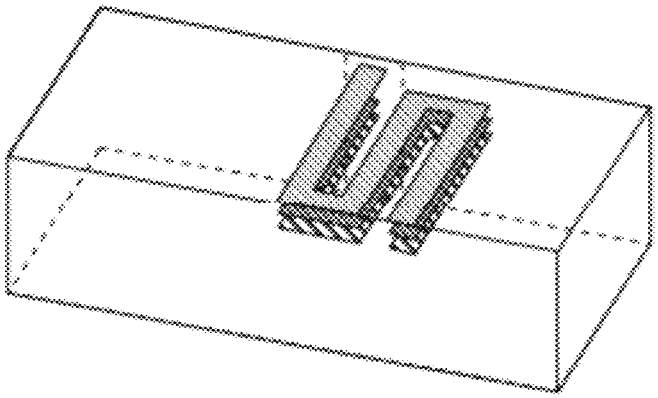
FIG. 7(C)
| | $f_0$ | $f_1$ | $f_1/f_0$ |
|---|---|---|---|
| A | 2612 | 13236 | 5.1 |
| B | 4752 | 13775 | 2.9 |

FIG. 8(A)
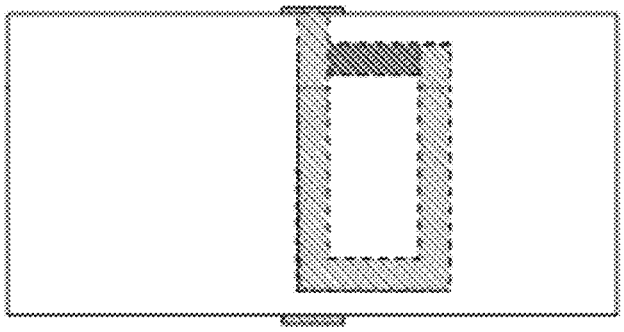
FIG. 8(B)
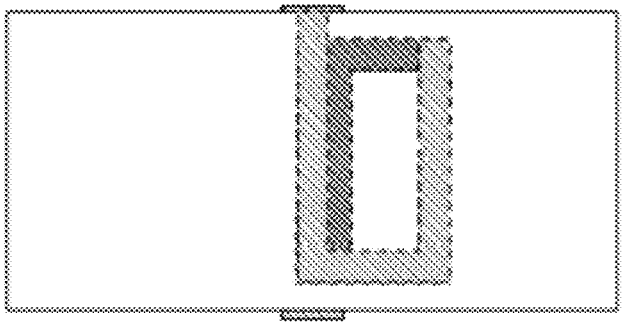
FIG. 8(C)
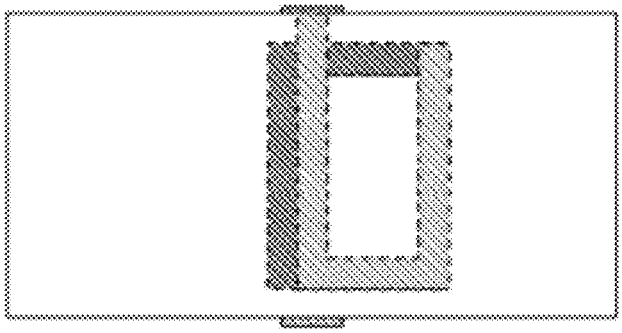
FIG. 8(D)
| | RESONANT LINE AREA (mm2) | $f_0$ | $f_1$ | $f_1/f_0$ |
|---|---|---|---|---|
| A | 0.103 | 2770 | 18019 | 6.5 |
| B | 0.103 | 3014 | 17849 | 5.9 |
| C | 0.123 | 2766 | 17542 | 6.3 |

FIG. 9(A)
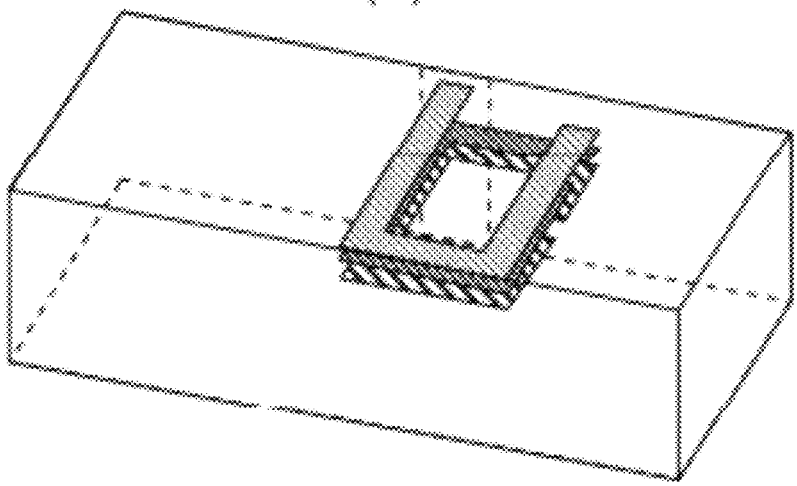
FIG. 9(B)
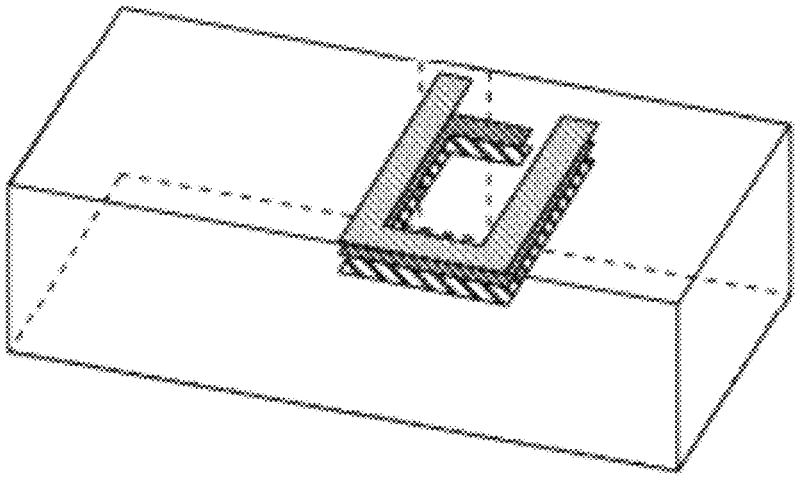
FIG. 9(C)
| | $f_0$ | $f_1$ | $f_1/f_0$ |
|---|---|---|---|
| A | 2612 | 13236 | 5.1 |
| B | 5305 | 14617 | 2.8 |

STRIPLINE FILTER

CROSS REFERENCE TO RELATED APPLICATIONS

The present application is a continuation of International Application No. PCT/JP2009/067604, filed Oct. 9, 2009, which claims priority to Japanese Patent Application No. JP2009-006547, filed Jan. 15, 2009, the entire contents of each of these applications being incorporated herein by reference in their entirety.

FIELD OF THE INVENTION

The present invention relates to a stripline filter in which striplines are provided on a dielectric board.

BACKGROUND OF THE INVENTION

A stripline filter in which a stripline-type resonator is provided on a dielectric board, is used in various fields (e.g., see Patent Document 1).

FIG. 1 is an equivalent circuit diagram of an existing micro stripline filter 101 derived from Patent Document 1.

The micro stripline filter 101 is a filter in which ¼ wavelength stripline resonators of two stages are comb-line coupled to each other and each ¼ wavelength stripline resonator is externally coupled to an input/output terminal through an external coupling capacity $C_{01}$. Each ¼ wavelength stripline resonator has a stepped impedance structure in which the line width is different between an open end side (118A, 118B) and a short-circuited end side (117A, 117B) and thus the impedance changes, and the electrical length is increased by making the line width on the open end side (118A, 118B) larger than the line width on the short-circuited end side (117A, 117B). By providing such a stepped impedance structure, even when the line length is shortened, a required electrical length is obtained, and the stripline filter can be reduced in size.

[Patent Document 1] Japanese Unexamined Patent Application Publication No. 7-312503

In the existing stripline filter, there is a limitation on adjustment of the electrical length by change of the line width, and it is necessary to also increase the actual line length in order to greatly increase the electrical length. Therefore, the stripline filter may need to be increased in size in order to achieve a desired low resonant frequency.

Further, for the stripline filter, there is a demand to appropriately set a spurious characteristic in a frequency band higher than the filter band, and there is a request to set a harmonic resonant frequency to a desired frequency in addition to a fundamental wave resonant frequency.

SUMMARY OF THE INVENTION

Therefore, an object of the present invention is to provide a stripline filter in which a fundamental wave frequency can be decreased without increasing a board in size and in which a harmonic frequency is easily set to a desired frequency.

A stripline filter according to the invention includes a dielectric board, an insulating layer, a ground electrode, resonant lines, and an input/output electrode. The insulating layer has a relative dielectric constant lower than that of the dielectric board and is laminated on a top surface of the dielectric board. The ground electrode is provided on a bottom surface of the dielectric board. The resonant lines face the ground electrode across the dielectric board and constitute a resonator. The input/output electrode inputs/outputs a signal to/from a resonance system including the resonant lines by external coupling. Here, at least one of the resonant lines includes an open end side line portion and a short-circuited end side line portion. The open end side line portion has an open end and is provided on the top surface of the dielectric board. The short-circuited end side line portion has an equivalent short-circuited end and extends on the insulating layer from a position connected to the open end side line portion.

In this configuration, by forming the resonant lines not only on the dielectric board but also in the insulating layer, the resonant line length can be increased without increasing the board in size. In addition, since the relative dielectric constant of the insulating layer is lower than that of the dielectric board, the effective relative dielectric constant of the resonant line is high at the open end side line portion facing the ground electrode across the dielectric board, and is low at the short-circuited end side line portion facing the ground electrode across the dielectric board and the insulating layer. Due to them, two effects that the resonant line is lengthened and the resonant line is provided with a kind of stepped impedance structure are caused, and the electrical length for the fundamental wave is increased to decrease the resonant frequency. Further, it is possible to set the ratio of the harmonic frequency to the fundamental wave frequency in accordance with the relative dielectric constant of the insulating layer, and it is easy to achieve a desired spurious characteristic. Practically, by shifting the harmonic frequency away from the fundamental wave frequency, it is possible to cause the harmonic frequency to deviate from a predetermined spurious band of frequencies higher than the filter band. In addition, mechanical protection and improvement of the environmental resistance of the resonant lines can be achieved by the insulating layer.

It is preferred if each of the open end side line portion and the short-circuited end side line portion has a line that is formed in a whirl shape when the dielectric board is viewed from the top. Here, the whirl shape is a trajectory shape obtained when a circle or a square is drawn, and includes a semi-circular shape and an L shape.

By forming each line portion in a whirl shape as described above, the electrical length for the fundamental wave can be increased as compared to that when each line portion is formed with the same area and in a meander shape, although details will be described below. In addition, it is possible to further increase the ratio of the harmonic frequency to the fundamental wave frequency.

It is preferred if the open end side line portion and the short-circuited end side line portion are spirally connected to each other.

By spirally connecting each line portion as described above, the electrical length for the fundamental wave can be increased as compared to that when each line portion is connected in a meander manner in a side view, although details will be described below. In addition, it is possible to further increase the ratio of the harmonic frequency to the fundamental wave frequency.

It is preferred if ends of the open end side line portion and the short-circuited end side line portion in a line width direction overlap each other when the dielectric board is viewed from the top.

By each line portion overlapping each other as described above, the electrical length for the fundamental wave per unit resonant line area can be increased as compared to that when each line portion is displaced from each other, although details will be described below. In addition, it is possible to further increase the ratio of the harmonic frequency to the fundamental wave frequency.

At least one of the resonant lines may be a ½ wavelength resonant line or a ¼ wavelength resonant line. By connecting two open end side line portions by the short-circuited end side line portion, the ½ wavelength resonant line can be formed. By providing the short-circuited end side line portion with the side surface line that extends on side surfaces of the insulating layer and the dielectric board and that is connected to the ground electrode, the ¼ wavelength resonant line can be formed.

At least two of the resonant lines may be interdigitally coupled to each other or comb-line coupled to each other. The interdigital coupling can be implemented by forming two of the resonant lines in spiral shapes of the same direction and adjacently locating the open end side line portions thereof. The comb-line coupling can be implemented by forming two of the resonant lines in spiral shapes of opposite directions and adjacently locating the open end side line portions thereof.

At least one of the resonant lines may be tap-connected at the short-circuited end side line portion thereof to the input/output electrode.

It is preferred if a ratio of a relative dielectric constant of the dielectric board and a relative dielectric constant of the insulating layer are set such that a ratio of a frequency of a harmonic to a frequency of a fundamental wave excited in the resonant lines is higher than that when the short-circuited end side line portion is not provided.

By setting the ratio of the relative dielectric constant of the dielectric board and the relative dielectric constant of the insulating layer as described above, the ratio of the harmonic frequency to the fundamental wave frequency is assuredly increased although details will be described below.

According to the invention, the resonant line has a kind of stepped impedance structure in which the effective relative dielectric constant is high at the open end side line portion and is low at the short-circuited end side line portion, and the characteristic impedance is low at the open end side line portion and is high at the short-circuited end side line portion. Therefore, the electrical length of the resonant line is increased. Further, the ratio of the harmonic frequency to the fundamental wave frequency can be set in accordance with the relative dielectric constant of the insulating layer. Thus, while the stripline filter is made smaller in size than the existing ones and the resonant frequency is suppressed, it is possible to appropriately set the spurious characteristic.

BRIEF DESCRIPTION OF DRAWINGS

FIGS. 5(A) to 5(G) are diagrams illustrating inspection results of influence due to differences in structure among resonant lines.

FIGS. 7(A) to 7(C) are diagrams illustrating inspection results of influence due to a difference in top view shape between resonant lines.

FIGS. 8(A) to 8(D) are diagrams illustrating inspection results of influence due to displacements of a top surface line.

FIGS. 9(A) to 9(C) are diagrams illustrating inspection results of influence due to a difference in side view shape between resonant lines.

DETAILED DESCRIPTION OF THE INVENTION

Hereinafter, a stripline filter according to an embodiment of the present invention will be described.

Figure 1:
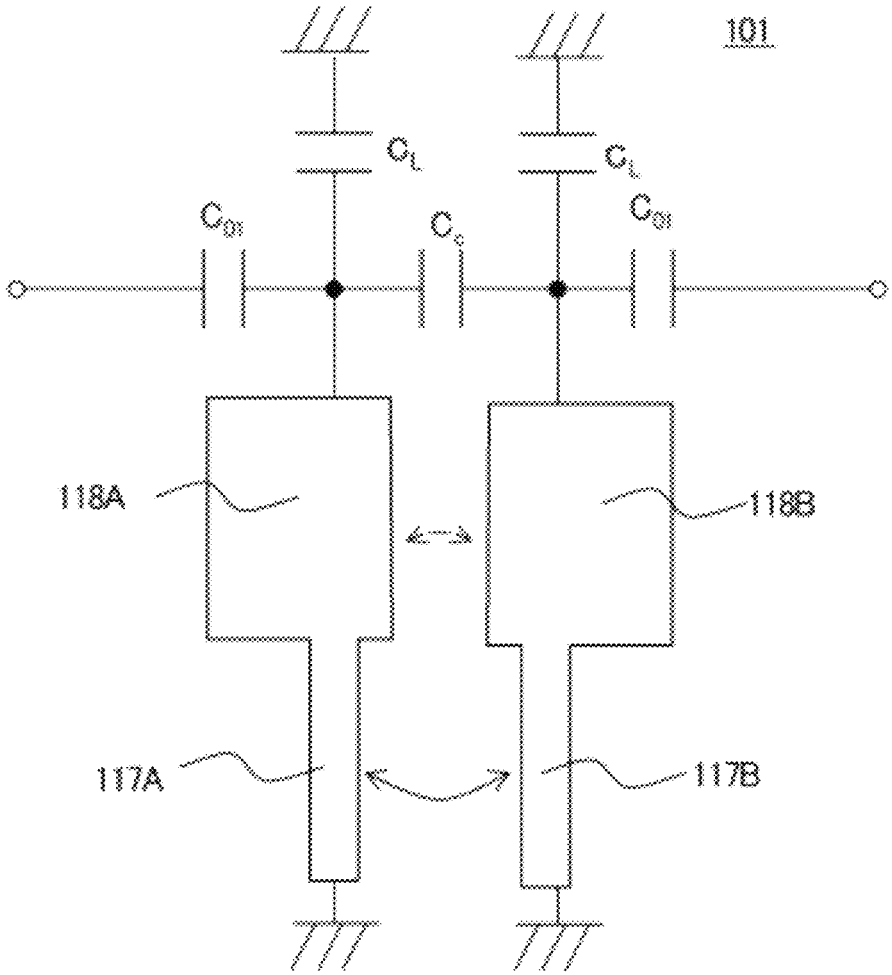
FIG. 1 PRIOR ART
FIG. 1 is an equivalent circuit diagram of an existing stripline filter.
Figure 2:
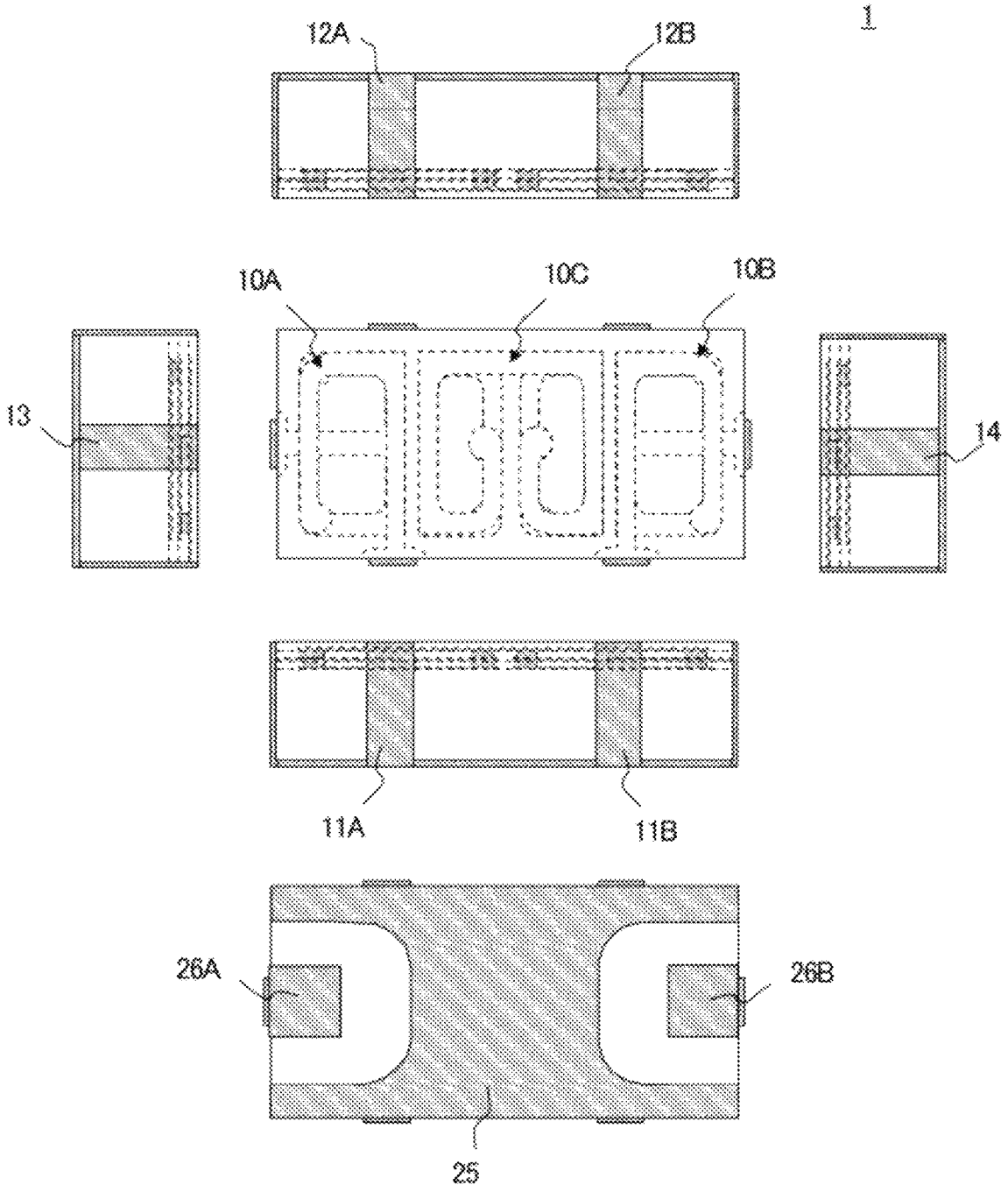
FIG. 2 is a development diagram of a stripline filter according to an embodiment of the present invention.

A stripline filter 1 according to the embodiment is a 3.6 GHz band-pass filter for WiMAX communication. FIG. 2 is a development diagram of the stripline filter 1.

The stripline filter 1 includes, in its inside, resonant lines 10A to 10C constituting resonators of three stages. The stripline filter 1 includes side surface lines 11A and 11B on its front surface. The stripline filter 1 includes side surface lines 12A and 12B on its back surface. The stripline filter 1 includes a side surface line 13 on its left side surface. The stripline filter 1 includes a side surface line 14 on its right side surface. The stripline filter 1 includes a ground electrode 25 and input/output electrodes 26A and 26B on its bottom surface that is a mounted surface. When the stripline filter 1 is mounted to a mounting board, high-frequency signal input/output terminals are connected to the input/output electrodes 26A and 26B, and a ground electrode on the mounting board is connected to the ground electrode 25 that has a ground surface for the resonator. Each of the ground electrode 25, the input/output electrodes 26A and 26B, and the side surface lines 11A, 11B, 12A, 12B, 13, and 14 is a silver electrode having a thickness of about 12 μm and is formed by applying a non-photosensitive silver paste to the board 3 by using a screen mask or a metal mask and performing burning.

Figure 3:
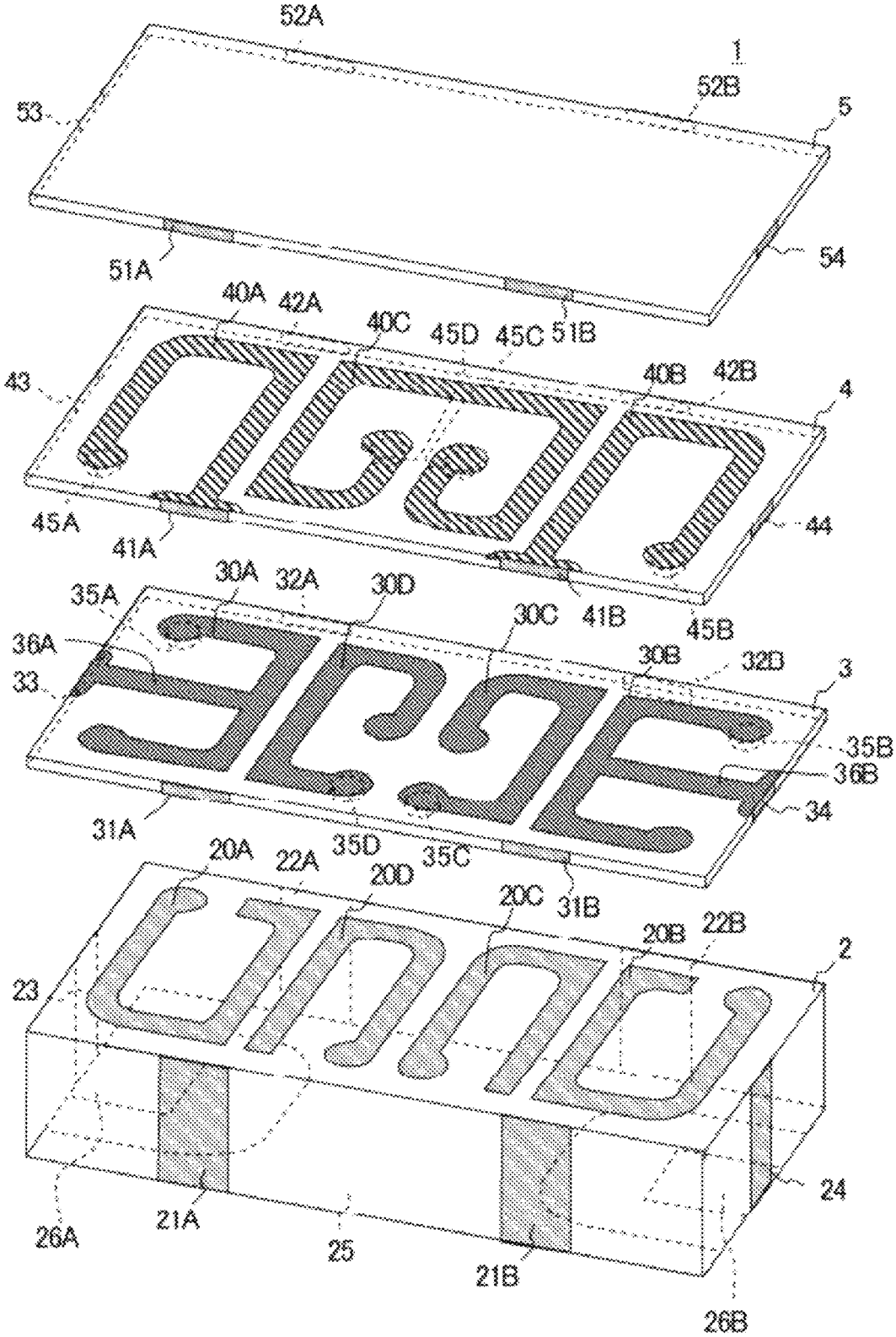
FIG. 3 is a top surface side exploded perspective view of the stripline filter shown in FIG. 2.

FIG. 3 is a top surface side exploded perspective view of the stripline filter 1.

In the stripline filter 1, a dielectric board 2, a glass layer 3, a glass layer 4, and a glass layer 5 are laminated in order from the bottom surface.

The dielectric board 2 is a rectangular plate-shaped ceramic-sintered board that is formed from titanium oxide or the like and that has a relative dielectric constant of about 190. The board 2 includes, on its top surface, top surface lines 20A to 20D each having a thickness of about 4 μm. The board 2 includes the ground electrode 25 and the input/output electrodes 26A and 26B on its bottom surface. The board 2 includes, on its front surface, side surface lines 21A and 21B constituting the side surface lines 11A and 11B. The board 2 includes, on its back surface, side surface lines 22A and 22B constituting the side surface lines 12A and 12B. The board 2 includes, on its left side surface, a side surface line 23 constituting the side surface line 13. The board 2 includes, on its right side surface, a side surface line 24 constituting the side surface line 14. The side surface lines 21A, 21B, 22A, and 22B are connected at their bottom surface side ends to the ground electrode 25. The side surface line 23 is connected at its bottom surface side end to the input/output electrode 26A. The side surface line 24 is connected at its bottom surface side end to the input/output electrode 26B.

The glass layer 3 is formed from a glass having a relative dielectric constant of 5 and is laminated with a thickness of about 20 μm on the top surface of the dielectric board 2 to achieve mechanical protection and improvement of the environmental resistance of the top surface lines 20A and 20D provided on the top surface of the dielectric board 2. The glass layer 3 includes, on its top surface, top surface lines 30A to 30D and tap connection lines 36A and 36B each having a thickness of about 6 μm. The glass layer 3 includes, on its front surface, side surface lines 31A and 31B constituting the side surface lines 11A and 11B. The glass layer 3 includes, on its back surface, side surface lines 32A and 32B constituting the side surface lines 12A and 12B. The glass layer 3 includes, on its left side surface, a side surface line 33 constituting the side surface line 13. The glass layer 3 includes, on its right side surface, a side surface line 34 constituting the side surface line 14. The glass layer 3 includes via holes 35A to 35D in its inside. The side surface line 33 is connected at its top surface side end to the tap connection line 36A. The side surface line 34 is connected at its top surface side end to the tap connection line 36B.

The glass layer 4 is formed from a glass having a relative dielectric constant of 5 and is laminated with a thickness of about 20 μm on the top surface of the glass layer 3 to achieve mechanical protection and improvement of the environmental resistance of the top surface lines 30A and 30D and the tap connection lines 36A and 36B which are provided on the top surface of the glass layer 3. The glass layer 4 includes, on its top surface, top surface lines 40A to 40C each having a thickness of about 6 μm. The glass layer 4 includes, on its front surface, side surface lines 41A and 41B constituting the side surface lines 11A and 11B. The glass layer 4 includes, on its back surface, side surface lines 42A and 42B constituting the side surface lines 12A and 12B. The glass layer 4 includes, on its left side surface, a side surface line 43 constituting the side surface line 13. The glass layer 4 includes, on its right side surface, a side surface line 44 constituting the side surface line 14. The glass layer 4 includes via holes 45A to 45D in its inside. The side surface lines 41A and 41B are connected at their top surface side ends to the top surface lines 40A and 40B.

The glass layer 5 is formed from a light blocking glass having a relative dielectric constant of 5 and is laminated with a thickness of about 20 μm on the top surface of the glass layer 4 to achieve mechanical protection and improvement of the environmental resistance of the top surface lines 40A to 40C provided on the top surface of the glass layer 4. The glass layer 5 includes, on its front surface, side surface lines 51A and 51B constituting the side surface lines 11A and 11B. The glass layer 5 includes, on its back surface, side surface lines 52A and 52B constituting the side surface lines 12A and 12B. The glass layer 5 includes, on its left side surface, a side surface line 53 constituting the side surface line 13. The glass layer 5 includes, on its right side surface, a side surface line 54 constituting the side surface line 14.

The top surface lines 20A to 20D, 30A to 30D, and 40A to 40C and the tap connection lines 36A and 36B are silver electrodes and are formed by applying a photosensitive silver paste to the board 2 or the glass layer 3 or 4, forming a pattern by a photolithographic process, and performing burning. By forming these electrodes as the photosensitive silver electrodes, the shape accuracy of the electrodes is increased to provide a stripline filter that can be used for WiMAX communication. In addition, each of the thicknesses of the electrodes on the side surfaces is made larger than each of the electrode thicknesses of the top surface lines 20A to 20D, 30A to 30D, and 40A to 40C and the tap connection lines 36A and 36B, whereby a current on the ground terminal side of the resonator where current crowding generally occurs is dispersed to reduce conductor loss.

The top surface line 20A has a rectangular C shape in which a side on the back surface side is opened, the outer edge of a corner between a side on the front surface side and a side on the left side surface side is rounded, the inner edges of all corners are rounded, and the left side surface side end has a circular shape. The top surface line 20D has a rectangular C shape in which a side on the front surface side is opened, the inner edge of a corner between a side on the back surface side and a side on the left side surface side is rounded, the inner edge and the outer edge of a corner between the side on the back surface side and a side on the right side surface side are rounded, and the right side surface side end has a circular shape. The top surface line 20C has a rectangular C shape in which a side on the front surface side is opened, the inner edge and the outer edge of a corner between a side on the back surface side and a side on the left side surface side are rounded, the inner edge of a corner between the side on the back surface side and a side on the right side surface side is rounded, and the left side surface side end has a circular shape. The top surface line 20B has a rectangular C shape in which a side on the back surface side is opened, the outer edge of a corner between a side on the front surface side and a side on the right side surface side is rounded, the inner edges of all corners are rounded, and the right side surface side end has a circular shape.

The top surface line 30A has a rectangular C shape in which a side on the left side surface side is opened, the inner edges of all corners are rounded, and both ends have circular shapes, respectively. The back surface side end of the top surface line 30A is connected to the left side surface side end of the top surface line 20A via the via hole 35A. The top surface line 30D has a rectangular C shape in which a side on the right side surface side is opened on the front surface side, the inner edges of all corners are rounded, the outer edge of a corner between a side on the back surface side and the side on the right side surface side is rounded, and both ends have circular shapes, respectively. The front surface side end of the top surface line 30D is connected to the right side surface side end of the top surface line 20D via the via hole 35D. The top surface line 30C has a rectangular C shape in which a side on the left side surface side is opened on the front surface side, the inner edges of all corners are rounded, the outer edge of a corner between a side on the back surface side and the side on the left side surface side is rounded, and both ends have circular shapes, respectively. The front surface side end of the top surface line 30C is connected to the left side surface side end of the top surface line 20C via the via hole 35C. The top surface line 30B has a rectangular C shape in which a side on the right side surface side is opened, the inner edges of all corners are rounded, and both ends have circular shapes, respectively. The back surface side end of the top surface line 30B is connected to the right side surface side end of the top surface line 20B via the via hole 35B.

The tap connection line 36A has an I shape, the left side surface side end thereof is connected to the top surface side end of the side surface line 33, and the right side surface side end thereof is connected to the center of the side of the top surface line 30A on the right side surface side. The tap connection line 36B has an I shape, the right side surface side end thereof is connected to the top surface side end of the side surface line 34, and the left side surface side end thereof is connected to the center of the side of the top surface line 30B on the left side surface side.

The top surface line 40A has a rectangular C shape in which a side on the front surface side is opened, the inner edge of a corner between a side on the back surface side and a side on the left side surface side is rounded, the inner edge of a corner between the side on the back surface side and a side on the right side surface side is rounded, and the left side surface side end has a circular shape. The left side surface side end of the top surface line 40A is connected to the front surface side end of the top surface line 30A via the via hole 45A, and the right side surface side end of the top surface line 40A is connected to the top surface side end of the side surface line 41A. The top surface line 40C has a rectangular C shape in which a side on the front surface side is opened at its center, and its both ends are bent toward the board center. Then, the inner edges of all corners are rounded, the outer edges of corners bent toward the board center are rounded, and both ends have circular shapes, respectively. The right side surface side end of the top surface line 40C is connected to the back surface side end of the top surface line 30C via the via hole 45C, and the left side surface side end of the top surface line 40C is connected to the back surface side end of the top surface line 30D via the via hole 45D. The top surface line 40B has a rectangular C shape in which a side on the front surface side is opened, the inner edge of a corner between a side on the back surface side and a side on the right side surface side is rounded, the inner edge of a corner between the side on the back surface side and a side on the left side surface side is rounded, and the right side surface side end has a circular shape. The right side surface side end of the top surface line 40B is connected to the front surface side end of the top surface line 30B via the via hole 45B, and the left side surface side end of the top surface line 40B is connected to the top surface side end of the side surface line 41B.

Therefore, the resonant line 10A is structured such that the top surface line 20A, the top surface line 30A, and the top surface line 40A are left-spirally (in a left-hand thread manner) connected to each other via the via holes 35A and 45A, and is a ¼ wavelength resonant line connected at the side surface line 11A to the ground electrode 25. The resonant line 10A constitutes a resonator of an input stage (output stage), the right side surface side end of the top surface line 20A is an open end of the resonator, and the bottom surface side end of the side surface line 11A is a short-circuited end of the resonator. Thus, in the resonant line 10A, the top surface line 20A corresponds to an open end side line portion of the present invention, and the via holes 35A and 45A, the top surface lines 30A and 40A, and the side surface line 11A constitute a short-circuited end side line portion of the present invention.

The resonant line 10B is structured such that the top surface line 20B, the top surface line 30B, and the top surface line 40B are right-spirally (in a right-hand thread manner) connected to each other via the via holes 35B and 45B, and is a ¼ wavelength resonant line connected at the side surface line 11B to the ground electrode 25. The resonant line 10B constitutes a resonator of an output stage (input stage), the left side surface side end of the top surface line 20B is an open end of the resonator, and the bottom surface side end of the side surface line 11B is a short-circuited end of the resonator. Thus, in the resonant line 10B, the top surface line 20B corresponds to the open end side line portion of the present invention, and the via holes 35B and 45B, the top surface lines 30B and 40B, and the side surface line 11B constitute the short-circuited end side line portion of the present invention.

The resonant line 10C is structured such that the top surface line 20C, the top surface line 30C, and the top surface line 40C are right-spirally (in a right-hand thread manner) connected to each other via the via holes 35C and 45C; and the top surface line 40C, the top surface line 30D, and the top surface line 20D are left-spirally (in a left-hand thread manner) connected to each other via the via holes 45D and 35D, and is a ½ wavelength resonant line. The resonant line 10C constitutes a resonator of an intermediate stage, each of the right side surface side end of the top surface line 20C and the left side surface side end of the top surface line 20D is an open end of the resonator, and the center portions of the top surface line 40C are equivalent short-circuited ends of the resonator. Thus, in the resonant line 10C, each of the top surface lines 20C and 20D corresponds to the open end side line portion of the present invention, and the via holes 35C, 45C, 45D, and 35D and the top surface lines 30C, 40C, and 30D constitute the short-circuited end side line portion of the present invention.

The left spiral portion (the top surface lines 20D, 30D, and 40D) of the resonant line 10C is adjacent to the left spiral resonant line 10A, and the resonant line 10A and the resonant line 10C are interdigitally coupled to each other. The right spiral portion (the top surface lines 20C, 30C, and 40C) of the resonant line 10C is adjacent to the right spiral resonant line 10B, and the resonant line 10B and the resonant line 10C are interdigitally coupled to each other. In addition, the resonant line 10A is externally coupled to the input/output electrode 26A by a tap connection via the tap connection line 36A and the side surface line 13. The resonant line 10B is externally coupled to the input/output electrode 26B by a tap connection via the tap connection line 36B and the side surface line 14. By causing the adjacent resonant lines to have spiral shapes of the same direction, interdigital coupling of them can be implemented. However, if one resonant line is caused to have a spiral shape of the opposite direction to provide a right spiral and a left spiral, comb-line coupling can also be implemented.

In this structure, by forming the resonant lines not only on the dielectric board but also in the insulating layer, the resonant line length can be increased without increasing the board in size. In addition, since the relative dielectric constant of the dielectric board 2 is high and the relative dielectric constants of the glass layers 3 and 4 are low, the effective relative dielectric constant of each of the resonant lines 10A to 10C can be higher on the open end side than on the short-circuited end side, and each of the resonant lines 10A to 10C can have a decreased characteristic impedance on the open end side. Thus, each of the resonant lines 10A to 10C has a kind of stepped impedance structure, the electrical length for the fundamental wave can be increased, and the fundamental wave frequency can be decreased even with the same area size as that in the existing art.

Further, the ratio of the harmonic frequency to the fundamental wave frequency can be set in accordance with the relative dielectric constants of the glass layers 3 and 4, and a desired spurious characteristic can be achieved by appropriately setting the actual line length and the relative dielectric constants of the glass layers 3 and 4. Specifically, by shifting the harmonic frequency away from the fundamental wave frequency, it is possible to cause the harmonic frequency to deviate from a predetermined spurious band of frequencies higher than the filter band.

Figure 4:
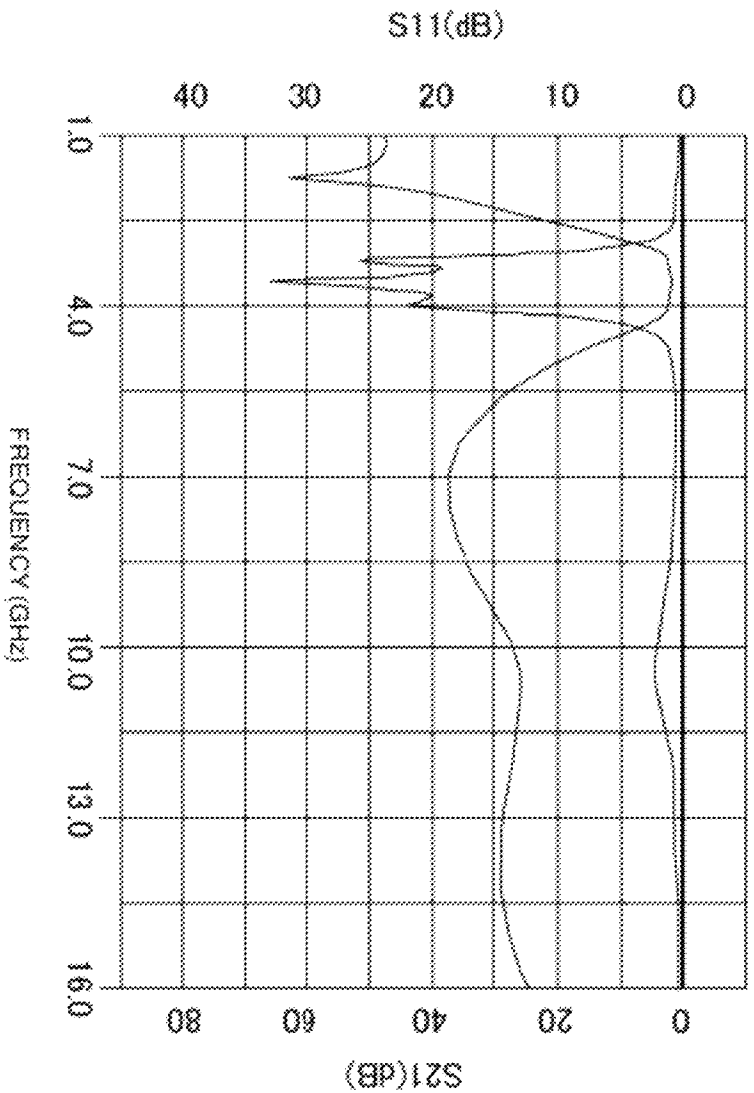
FIG. 4 is a diagram showing filter characteristics of the stripline filter shown in FIG. 2.

Here, FIG. 4 shows an example of filter characteristics provided when the stripline filter 1 of this structure has a size of 1.0×0.5×0.4 mm. In the stripline filter 1, about 3300 to 3800 MHz is a pass band of the fundamental wave. In this case, the harmonic frequency shifts away from the fundamental wave frequency, and in a spurious band (about 6600 to 15200 MHz) corresponding to second to fourth harmonics as well, an attenuation amount of 25 dB or more can be ensured.

It should be noted that the side surface lines 12A and 12B are formed so as to be spaced apart from the top surface lines 20A to 20D and have little effect on the filter characteristics, and thus are not electrically essential components. However, by providing the side surface lines 12A and 12B, the electrode pattern on the back surface and the electrode pattern on the front surface are the same and symmetrical to each other about a point, whereby a manufacturing process is facilitated. Specifically, pattern formation can be performed without separating arrangements of the front and back surfaces and separating arrangements of the top and bottom surfaces, and the same metal mask or screen mask can be used. In addition, the electrode pattern on the left side surface and the electrode pattern on the right side surface are also formed to be the same and symmetrical to each other about a point, whereby the manufacturing process is facilitated.

Next, inspection results of the effects of the present invention will be described.

FIGS. 5(A) to 5(G) are diagrams illustrating change of the fundamental frequency due to structure. FIG. 5(A) is a diagram showing an existing structure in which a ¼ wavelength resonant line is provided with a single layer on a dielectric board. FIG. 5(B) is a diagram showing an existing structure in which a ½ wavelength resonant line is provided with a single layer on a dielectric board. FIG. 5(C) is a diagram showing a comparative structure in which a ¼ wavelength resonant line is provided with three layers and a short-circuited end side of the resonant line is located on a dielectric board. FIG. 5(D) is a diagram showing a comparative structure in which a ½ wavelength resonant line is provided with three layers and a short-circuited end side of the resonant line is located on a dielectric board. FIG. 5(E) is a diagram showing an embodiment structure in which a ¼ wavelength resonant line is provided with three layers and an open end side of the resonant line is located on a dielectric board. FIG. 5(F) is a diagram showing an embodiment structure in which a ½ wavelength resonant line is provided with three layers and an open end side of the resonant line is provided on a dielectric board.

FIG. 5(G) is a table showing the fundamental wave frequency of each structure. The fundamental wave frequencies (a) of the ¼ wavelength resonant line of FIG. 5(A) and the ½ wavelength resonant line of FIG. 5(B) of the existing structures are 8502 MHz and 9222 MHz, respectively. In contrast, the fundamental wave frequencies (b) of the ¼ wavelength resonant line of FIG. 5(C) and the ½ wavelength resonant line of FIG. 5(D) of the comparative structures are 8287 MHz an 8709 MHz, respectively, and the degree by which each fundamental wave frequency is changed from that of the existing structure is less than 10%. Such a degree of frequency change is used only for fine adjustment, and it is difficult to greatly reduce the stripline filter in size. Meanwhile, the fundamental wave frequencies (c) of the ¼ wavelength resonant line of FIG. 5(E) and the ½ wavelength resonant line of FIG. 5(F) of the embodiment structures are 3993 MHz and 3835 MHz, respectively, and the degree by which each fundamental wave frequency is changed from that of the existing structure is equal to or more than 50%, which is great. In other words, it can be said that with the same frequency, the stripline filter can be greatly reduced in size.

Next, inspection results of influence of a relative dielectric constant on the harmonic frequency will be described.

FIGS. 6(*a*) to 6(H) are diagrams illustrating change of a harmonic frequency $f_1$ due to a difference in relative dielectric constant ∈'r between glass layers. The relative dielectric constant of a dielectric board is indicated by ∈r, and the fundamental wave frequency of the dielectric board is indicated by $f_0$. FIG. 6(A) is a diagram showing an existing structure in which a ¼ wavelength resonant line is provided with a single layer on a dielectric board. FIG. 6(B) is a diagram showing an existing structure in which a ½ wavelength resonant line is provided with a single layer on a dielectric board. FIG. 6(C) is a diagram showing an embodiment structure in which a ¼ wavelength resonant line is provided with two layers. FIG. 6(D) is a diagram showing an embodiment structure in which a ½ wavelength resonant line is provided with two layers. FIG. 6(E) is a diagram showing an embodiment structure in which a ¼ wavelength resonant line is provided with three layers. FIG. 6(F) is a diagram showing an embodiment structure in which a ½ wavelength resonant line is provided with three layers.

Figure 6A:
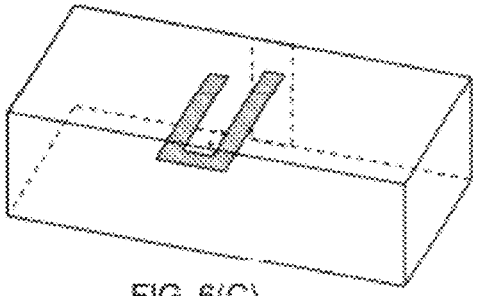
FIGS. 6(A) to 6(H) are diagrams illustrating inspection results of influence due to differences in relative dielectric constant.
Figure 6B:
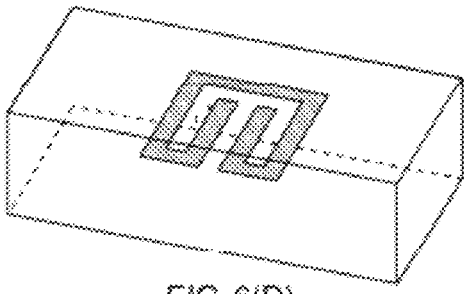
Figure 6C:
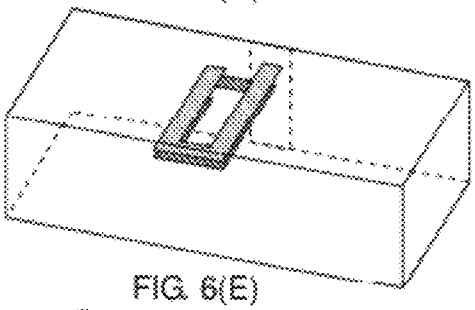
Figure 6D:
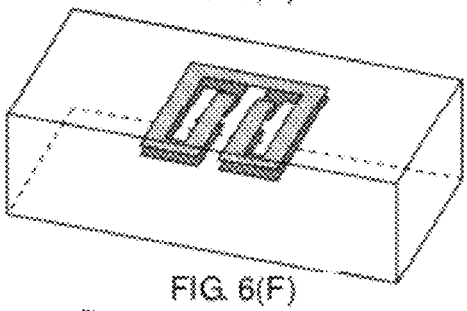
Figure 6E:
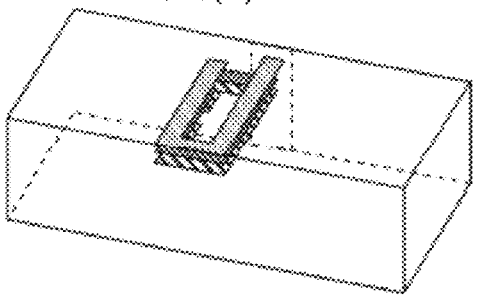
Figure 6F:
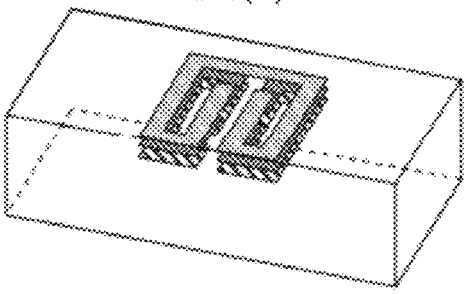
Figure 6G:
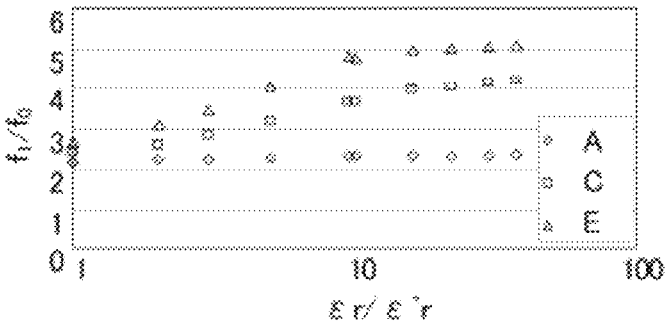
Figure 6H:
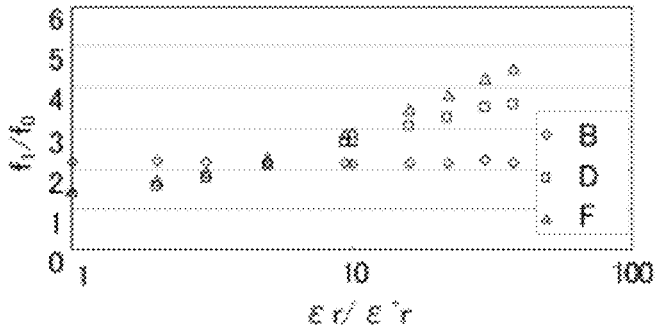

FIG. 6(G) is a graph showing change of a frequency ratio $f_1/f_0$ relative to a relative dielectric constant ratio ∈r/∈'r in each ¼ wavelength resonant line. In addition, FIG. 6(H) is a graph showing change of a frequency ratio $f_1/f_0$ relative to a relative dielectric constant ratio ∈r/∈'r in each ½ wavelength resonant line.

In the existing structures of FIGS. 6(A) and 6(B), the dielectric constant of the glass layer does not influence the frequency ratio $f_1/f_0$, and the frequency ratio $f_1/f_0$ is almost constant.

On the other hand, in the embodiment structures of FIGS. 6(C), 6(D), 6(E), and 6(F), when the ratio ∈r/∈'r increases, that is, when the relative dielectric constant ∈'r of the glass layer is suppressed, the ratio $f_1/f_0$ also increases and the harmonic frequency $f_1$ shifts away from the fundamental wave frequency $f_0$. This tendency is more significant in the embodiment structures of FIGS. 6(E) and 6(F) of three layers than in the embodiment structures of FIGS. 6(C) and 6(D) of two layers. As described above, by setting the relative dielectric constants of the glass layers 3, 4, and 5 as insulating layers to be lower than the relative dielectric constant of the dielectric board 2, the harmonic frequency can be shifted away from the fundamental wave frequency.

It should be noted that in the ½ wavelength resonant lines of FIGS. 6(B), 6(D), and 6(F), as a result, when the relative dielectric constant ∈'r of the glass layer is close to the relative dielectric constant ∈r of the dielectric board, the harmonic frequency is closer to the fundamental wave frequency than that in the existing structure. Therefore, it is preferred that the ratio ∈r/∈'r is set such that the ratio $f_1/f_0$ is higher than that when a short-circuited end side line portion is not provided. In this example, when the relative dielectric constant ∈'r of the glass layer is equal to or less than that of ⅕ of the relative dielectric constant ∈r of the dielectric board, the harmonic frequency can be shifted away from the fundamental wave frequency.

Next, inspection results of influence of the top view shape of a resonant line will be described.

FIGS. 7(A) to 7(C) are diagrams illustrating change of a fundamental wave frequency $f_0$ and a harmonic frequency $f_1$ due to a difference in top view shape between resonant lines. FIG. 7(A) is a diagram showing an exemplary structure in which a ¼ wavelength resonant line is provided with three layers and the shape of each layer is a whirl shape. FIG. 7(B) is a diagram showing an exemplary structure in which a ¼ wavelength resonant line is provided with three layers and the shape of each layer is a meander shape.

FIG. 7(C) is a table showing a fundamental wave frequency $f_0$, a harmonic frequency $f_1$, and a ratio $f_1/f_0$ in each exemplary structure.

It is confirmed that in the exemplary structure of FIG. 7(A) of the whirl shape, the fundamental wave frequency $f_0$ can be suppressed and the ratio $f_1/f_0$ can be increased, as compared to those in the exemplary structure of FIG. 7(B) of the meander shape. This is thought to be because in the resonant line of the meander shape, the electromagnetic field is likely to be disturbed due to the narrow interval between adjacent lines and the inductive component of the resonant line is suppressed. Therefore, when it is intended to increase the electrical length of the resonant line and shift the harmonic frequency away from the fundamental wave frequency, it is desired that the resonant line is formed in a whirl shape.

Next, inspection results of influence of displacement of a top surface line will be described.

FIGS. 8(A) to 8(D) are diagrams illustrating change of a fundamental wave frequency $f_0$ and a harmonic frequency $f_1$ when the second layer top surface line of a resonant line formed in a whirl shape with three layers is displaced. FIG. 8(A) is a diagram showing an exemplary structure in which each top surface line faces each other along the same line in a top view, FIG. 8(B) is a diagram showing an exemplary structure in which the second layer top surface line is displaced inwardly from the line in a top view, and FIG. 8(C) is a diagram showing an exemplary structure in which the second layer top surface line is displaced outwardly from the line in a top view.

FIG. 8(D) is a table showing a fundamental wave frequency $f_0$, a harmonic frequency $f_1$, and a ratio $f_1/f_0$ in each exemplary structure.

It is confirmed that in the exemplary structure of FIG. 8(A) in which the second layer top surface line agrees with the annular line, the fundamental wave frequency $f_0$ can be suppressed and the ratio $f_1/f_0$ can be increased, as compared to those in the exemplary structure of FIG. 8(B) in which the second layer top surface line is displaced inwardly from the annular line. Also in the exemplary structure of FIG. 8(C) in which the second layer top surface line is displaced outwardly from the annular line, the fundamental wave frequency $f_0$ can be suppressed as compared to that in the exemplary structure of FIG. 8(B). This is thought to be because the area of the formed resonant line in a top view increases, the line length increases, and the electrical length also increases. Therefore, when it is intended to increase the electrical length of the resonant line and shift the harmonic frequency away from the fundamental wave frequency, it is desired that the resonant line is formed such that an end of a top surface line of each layer in a line width direction overlaps each other.

Next, inspection results of influence of a manner of connecting top surface lines will be described.

FIGS. 9(A) to 9(C) are diagrams illustrating changes of a fundamental wave frequency $f_0$ and a harmonic frequency $f_1$ when a resonant line formed to have a whirl shape with three layers is spirally connected and when each top surface line has the same shape and is connected in a meander manner in a side view. FIG. 9(A) is a diagram showing an exemplary structure in which each top surface line is spirally connected, and FIG. 8(B) is a diagram showing an exemplary structure in which each top surface line is connected in a meander manner in a side view.

FIG. 9(C) is a table showing a fundamental wave frequency $f_0$, a harmonic frequency $f_1$, and a ratio $f_1/f_0$ in each exemplary structure.

It is confirmed that in the exemplary structure of FIG. 9(A) in which each top surface line is spirally connected, the fundamental wave frequency $f_0$ can be suppressed and the ratio $f_1/f_0$ can be increased, as compared to those in the exemplary structure of FIG. 9(B) in which each top surface line is connected in a meander manner in a side view. Therefore, when it is intended to increase the electrical length of the resonant line and shift the harmonic frequency away from the fundamental wave frequency, it is desired that the top surface line of each layer constituting the resonant line is configured to be spirally connected.

The arranged position and the shape of the top surface line in each embodiment described above are according to the product specifications, and may be any arranged position and shape according to the product specifications. The present invention is applicable to a configuration other than the above configurations, and can be used for various pattern shapes of filters. Further, another configuration (a high-frequency circuit) may be provided to the filter. The scope of the present invention is indicated by the claims, not by the embodiments described above, and all changes that come within the meaning and range of equivalents of the claims are intended to be embraced therein.

REFERENCE NUMBERS

1 stripline filter
2 dielectric board
3, 4, 5 glass layer
10A to 10C resonant line
11A, 11B, 12A, 12B, 13, 14 side surface line
20A to 20D, 30A to 30D, 40A to 40C top surface line
25 ground electrode
26A, 26B input/output electrode
35A to 35D, 45A to 45D via hole
36A, 36B tap connection line

The invention claimed is:

1. A stripline filter comprising:
a dielectric board having first and second opposed surfaces;
an insulating layer having a relative dielectric constant lower than that of the dielectric board and is adjacent the first surface of the dielectric board;
a ground electrode on the second surface of the dielectric board;
resonant lines that face the ground electrode with the dielectric board therebetween; and
an input/output electrode for inputting/outputting a signal to/from the resonant lines by external coupling, wherein
at least one of the resonant lines includes:
an open end side line portion having an open end and no short circuited end, and positioned on the first surface of the dielectric board; and
a short-circuited end side line portion having a short-circuited end and no open end, and which extends on the insulating layer and is connected to the open end side line portion, and
wherein each of the open end side line portion and the short-circuited end side line portion has a respective line that is in a whirl shape when the dielectric board is viewed from the first surface.

2. The stripline filter according to claim 1, wherein the open end side line portion and the short-circuited end side line portion are spirally connected to each other.

3. The stripline filter according to claim 1, wherein ends of the open end side line portion and the short-circuited end side line portion overlap each other in a line-width direction when the dielectric board is viewed from the first surface.

4. A stripline filter comprising:
a dielectric board having first and second opposed surfaces;
an insulating layer having a relative dielectric constant lower than that of the dielectric board and is adjacent the first surface of the dielectric board;
a ground electrode on the second surface of the dielectric board;
resonant lines that face the ground electrode with the dielectric board therebetween; and
an input/output electrode for inputting/outputting a signal to/from the resonant lines by external coupling, wherein
at least one of the resonant lines includes:
an open end side line portion having an open end and no short circuited end, and positioned on the first surface of the dielectric board; and a short-circuited end side line portion having a short-circuited end and no open end, and which extends on a surface of the insulating layer that is not adjacent to the first surface of the dielectric board and is connected to the open end side line portion.

5. The stripline filter according to claim 4, wherein the insulating layer is laminated to the first surface of the dielectric board.

6. The stripline filter according to claim 4, wherein the at least one of the resonant lines is a ½ wavelength resonant line having two of the open end side line portions connected to each other by the short-circuited end side line portion.

7. The stripline filter according to claim 4, wherein the at least one of the resonant lines is a ¼ wavelength resonant line, and the short-circuited end side line portion of the ¼ wavelength resonant line is provided with a side surface line that extends on side surfaces of the insulating layer and the dielectric board and is connected to the ground electrode.

8. The stripline filter according to claim 4, wherein at least two of the resonant lines have spiral shapes of a same direction, and the open end side line portions thereof are adjacent to each other, and the at least two of the resonant lines includes the at least one of the resonant lines.

9. The stripline filter according to claim 1, wherein at least two of the resonant lines have spiral shapes of opposite directions, and the open end side line portions thereof are adjacent to each other, and the at least two of the resonant lines includes the at least one of the resonant lines.

10. The stripline filter according to claim 4, wherein the at least one of the resonant lines is tap-connected to the input/output electrode at the short-circuited end side line portion thereof.

11. The stripline filter according to claim 4, wherein the insulating layer is positioned between the short-circuited end side line portion and the dielectric board.

12. The stripline filter according to claim 4, wherein the insulating layer is comprised of a plurality of insulating layers.

13. A stripline filter comprising:

a dielectric board having first and second opposed surfaces;

an insulating layer having a relative dielectric constant lower than that of the dielectric board and is adjacent the first surface of the dielectric board;

a ground electrode on the second surface of the dielectric board;

resonant lines that face the ground electrode with the dielectric board therebetween; and an input/output electrode for inputting/outputting a signal to/from the resonant lines by external coupling, wherein at least one of the resonant lines includes:

an open end side line portion having an open end and positioned on the first surface of the dielectric board; and a short-circuited end side line portion having a short-circuited end which extends on the insulating layer and is connected to the open end side line portion, and wherein a ratio of a first relative dielectric constant of the dielectric board and a second relative dielectric constant of the insulating layer is such that a ratio of a frequency of a harmonic to a frequency of a fundamental wave excited in the resonant lines is greater than that when the short-circuited end side line portion is not provided.

* * * * *